United States Patent [19]

Schlottke

[11] Patent Number: 5,042,535

[45] Date of Patent: Aug. 27, 1991

[54] AUTOMATIC TIE GUN

[75] Inventor: Horst Schlottke, Tangstedt, Fed. Rep. of Germany

[73] Assignee: Bowthorpe-Hellermann Limited, Crawley, England

[21] Appl. No.: 496,406

[22] Filed: Mar. 20, 1990

[30] Foreign Application Priority Data

Mar. 30, 1989 [GB] United Kingdom ..... 8907143

[51] Int. Cl.[5] ..... B21F 9/02

[52] U.S. Cl. ..... 140/93 A; 24/16 PB; 140/93.2

[58] Field of Search ..... 72/93 A, 93.2, 123.6; 24/16 PB

[56] References Cited

U.S. PATENT DOCUMENTS 3,976,108 8/1976 Caveney et al. ..... 140/93 A

*Primary Examiner*—Lowell A. Larson

*Attorney, Agent, or Firm*—Lockwood, Alex, FitzGibbon & Cummings

[57] ABSTRACT

A tool for applying a flexible, one-piece plastics tie around a bundle of cables drives the tie tail-first from the tool where it is guided around the bundle so that upon completion of this step, the free end of the tail is spaced from but aligned with and directed towards an aperture through a head at the other end of the tail. A pushing element of the tool is then displaced to engage in a notch in an edge of the tail, to push the free end of the tail through the head, where it interlocks.

18 Claims, 3 Drawing Sheets

1/3

2/3

AUTOMATIC TIE GUN

This invention relates to an automatic tool or gun for applying flexible, one piece plastics ties around for example a bundle of cables, each tie having a flat tail and an apertured head at one end of the tail. More particularly, the present invention relates to an automatic tie tool or gun for applying flexible ties around a bundle of cables in which the tool or gun has an improved mechanism for threading the tie tail through the tie head, which positively engages an engagement portion integrally formed in the tie. The invention also relates to a tie for use by the tool.

European patent 0 035 367B discloses an automatic tie gun which feeds from a supply of ties in the form of a bandolier or belt in which the ties are disposed side-by-side with each other and are interconnected by integral bridging elements. This arrangement provides very considerable advantages as regards feeding the gun because the ties can be moulded in bandolier form and do not require assembling individually into a magazine, as in other tie guns. The gun described in European patent 0 035 367B includes indexing means for advancing the bandolier such that the leading tie thereof is stepped laterally into a tail-forward, ready position within the gun, means for cutting the leading tie from the bandolier, means for driving tail-first from the gun the tie which is in the tail forward, ready position, and means at the forward end of the gun for guiding the tie tail around the bundle to be tied as the tie is driven from the gun and arranged so that the free end of the tail passes through the apertured head to interlock therein. The gun further includes means for engaging the free end of the tail, which is projecting through the apertured head of the tie, and driving it to tension the tie around the bundle being tied, a knife for cutting the tail behind the head and a tension-sensing means for actuating the knife when a predetermined tension in the tie is reached.

In the gun illustrated in the drawings of European patent 0 035 367B, a reciprocating push rod is provided for pushing the tie tail-first out of the gun and this push rod is provided with means for engaging the free end of the tail, once passed through the apertured head of the tie, so that the return movement of the push rod serves to pull the tail through the head and tension the tie. However the required length of stroke of the push rod necessarily leads to the gun having an undesirably large overall length, which is contrary to a preference for the gun to be hand-held in use and therefore compact and light in weight. Further, in the, gun illustrated in European patent 0 035 367B, the head of the tie is bent relative to the remainder of the tail so that its aperture is ready to receive its free end of the tail as the tail, after being guided around the bundle to be tied, is guided back into the gun whilst the head is being driven forwardly by the push rod over the final portion of its travel. This bending of the head leads to complexities and so too does removal of the cut-off tail end of the tie in the same passage as the next tie is to be driven forwardly during its application.

U.S. Pat. No. 4,640,320 discloses an improved tie gun in which a driven pinch wheel engages the tail of each successive tie which is in the tail-forward, ready position within the gun, to drive that tie tail-first from the gun. The tie tail is guided around the bundle to be tied so that, upon completion of the tie-driving step, the free end of the tail is spaced from the head but is aligned with and directed towards the head aperture: a threading mechanism then displaces the head towards the free end of the tail, so that the latter passes through and interlocks within the head aperture, and then the threading mechanism carries the head in the return direction. The tail interlocks within the head upon the initial displacement of the head by the threading mechanism and the return movement of the threading mechanism serves, whilst carrying the tie head, to advance the free end of the tail into engagement with another driven pinch wheel for tensioning the tail. These arrangements avoid the above-noted drawbacks of the gun illustrated in the drawings of European patent 0 035 367B, but the threading mechanism is still relatively complex and can be unreliable. The object of this invention is to provide a gun which overcomes these difficulties.

In accordance with this invention there is provided a tool for applying flexible, one-piece plastics ties around for example a bundle of cables, each tie having a flat tail and an apertured head at one end of the tail, the tie applying tool comprising means for driving tail-first from the tool a tie which is in a tail-forward, ready position within the tool, means at the forward end of the tool for guiding the tie tail around the bundle to be tied as the tie is driven from the tool so that, upon completion of the tie-driving and guiding step, the free end of the tail is spaced from the head but is aligned with and directed towards the head aperture, and threading means for next engaging the free end of the tail and displacing it so that it passes through the head aperture to interlock therein.

Preferably the threading means includes a displaceable pushing element which enters an engagement means integral with the tie in the form of a notch or recess disposed in one edge of the tie tail to push the free end of the tail through the head aperture.

Also in accordance with this invention, there is provided a one-piece tie of plastics material comprising a flat tail and an apertured head at one end of the tail, a notch or recess being formed in an edge of the tail adjacent its free end for engagement by the displaceable pushing element of the threading means.

An embodiment of this invention will now be described by way of example only and with reference to the accompanying drawings, in which.

Figure 3:
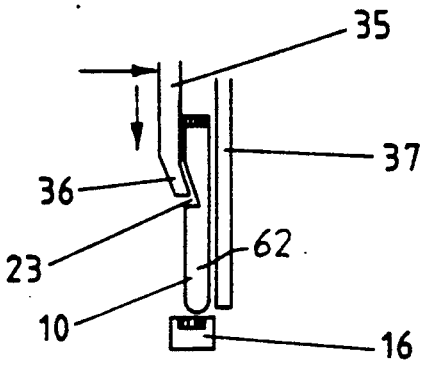
FIG. 3 is a view in the direction of arrow X in FIG. 2, showing the positions of the tie and tool components after the threading mechanism has been displaced into engagement with the free end of the tie tail and ready to push the free end of the tie tail through the apertured head of the tie.
Figure 6:
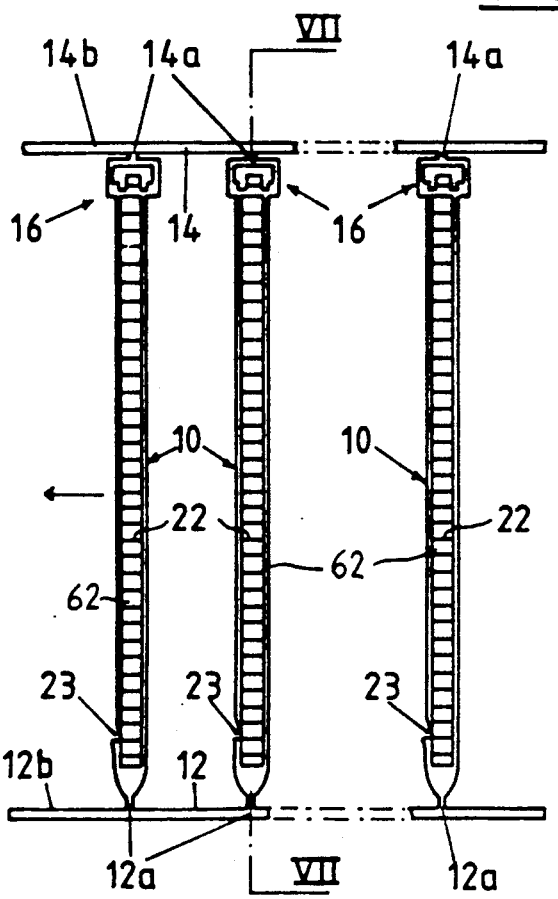
FIG. 6 is a plan view of a tie bandolier for use with the tie applying tool.
Figure 7:
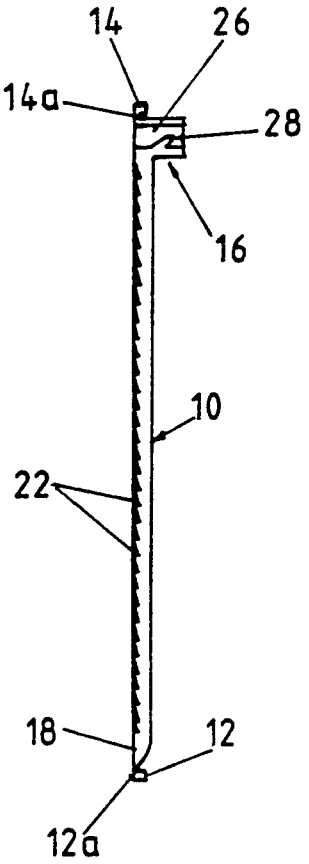
FIG. 7 is a section on the line VII—VII of FIG. 6.

Referring to the drawings, there is shown an automatic tool or gun for appplying flexible, one-piece plastics ties around for example a bundle of cables. The tool which is shown is arranged to feed from a bandolier of ties such as shown in FIGS. 6 and 7. The tie bandolier 1 comprises ties 10 disposed side by side and interconnected by narrow strips 12, 14 running along lines beyond the tail tips 18 and tie heads 16, respectively, and connected to the tail tips and heads by short filaments 12*a*, 14*a*. In each tie, the tail has one side formed with a series of transverse ratchet serrations 22 and at one end the head 16 projects from the other side of the tail and is itself wider than the tail. The head has an aperture 26 extending generally transversely of the plane of the tail, from the serrated side of the tail. The series of serrations 22 extend as far as the entry of aperture 26 as shown. Within this aperture there is formed a pivoted pawl 28 having teeth complementary to the ratchet serrations of the tail. Upon passing the free end of the tail through the head from the entry end of the aperture, the pawl rides on the serrations to permit free passage of the tail but any return movement of the tail is prevented by an interlock between the pawl in the head and the serrations on the tail. Each tie is formed with an engagement means in the form of a notch or recess 23 for cooperation with the threading mechanism of the tie applying tool as will be described. As shown in FIGS. 3 and 6, the notch 23 is preferably located in a longitudinal edge 11 of the tie tail 18 proximate to the tip portion thereof.

The tie applying tool comprises an entry gate for receiving the leading end of a tie bandolier as shown in FIGS. 6 and 7, and an indexing drum for advancing the tie bandolier and to sever the leading tie from the bandolier and step it into a tail-forward, ready position within the tool. A tie in this position is shown at 10(R) in FIG. 1. The tool further comprises a mechanism to drive that tie tail-forward from the tool once an upper guide jaw 58 of the tool has been pivoted closed onto a fixed lower guide jaw 57. The arrangements of the entry gate, indexing drum and tie driving mechanism are as described in our commonly owned U.S. Pat. No. 4,640,320, issued Feb. 3, 1987 for "Automatic Tie Gun", the disclosure of which is incorporated herein by reference. The tie driving mechanism of the present invention comprises a driven pinch wheel 51 which engages the serrated side of the tie which is in the tail-forward ready position R to drive that tie tail-forward from the tool. A cam wheel 52 having a recess 53 then receives the head 16 of the tie and then further rotates to push on the rear end of the head to advance the tie through a final distance.

Figure 1:
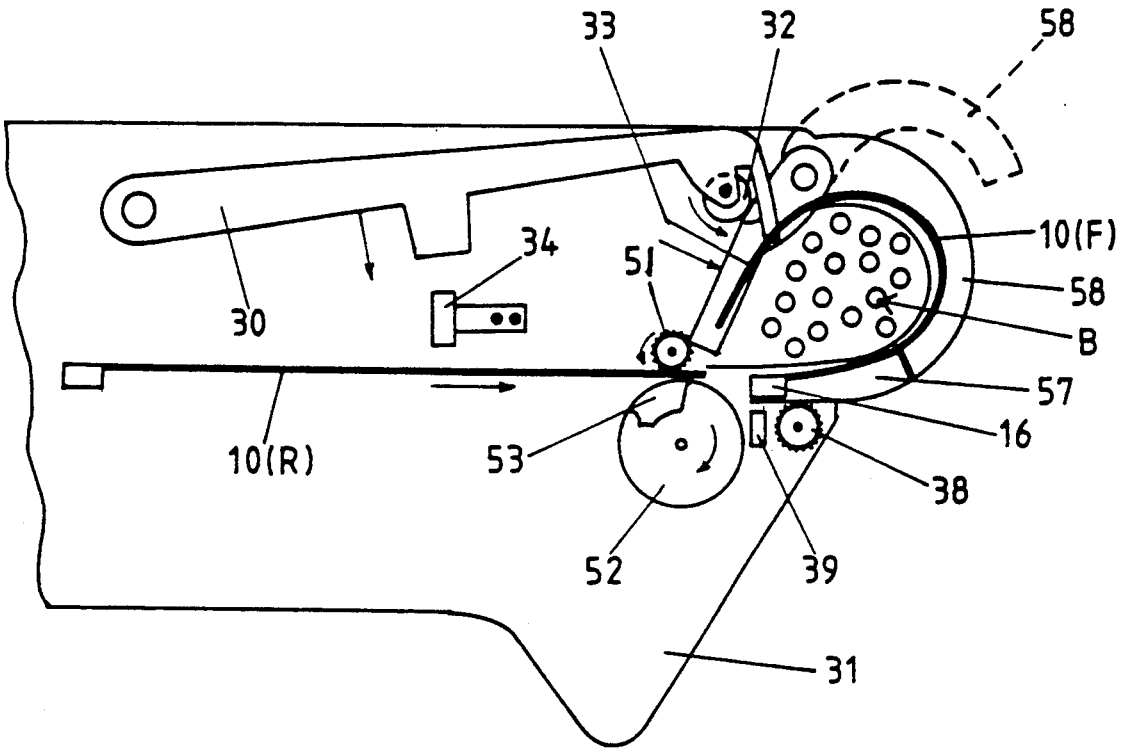
FIG. 1 is a diagrammatic side view of a forward portion of a tie applying tool in accordance with this invention, showing a tie after it has been guided around a bundle of cables.
Figure 2:
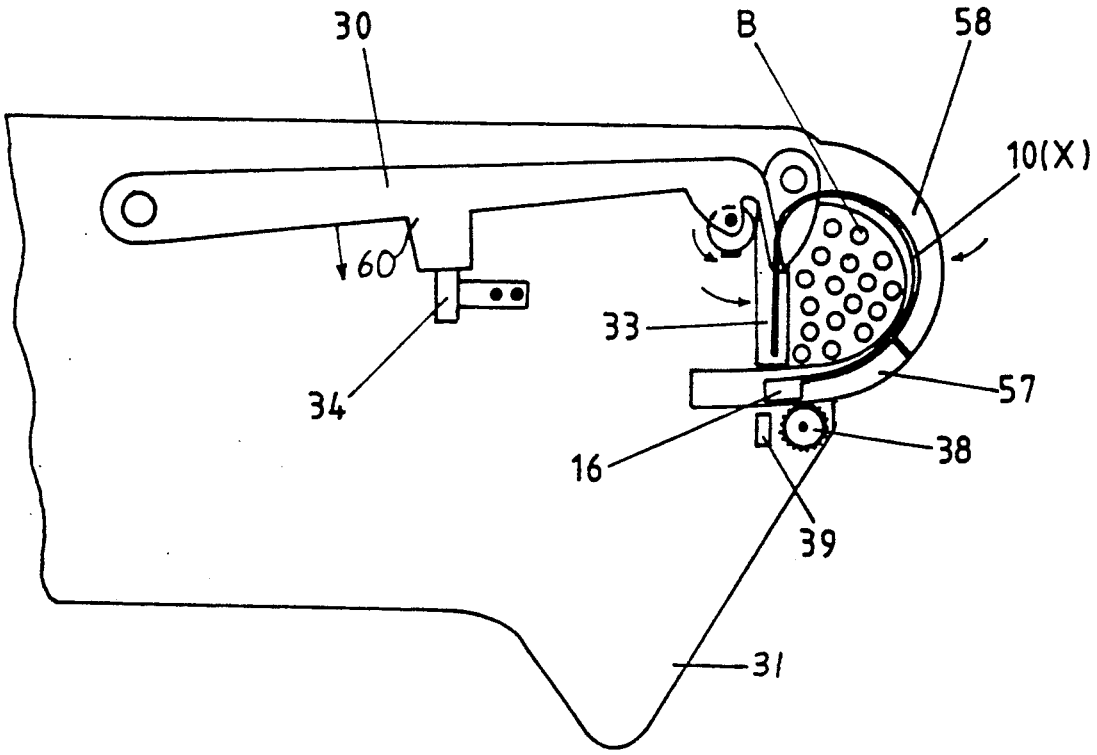
FIG. 2 is a similar view showing the tie and components of the tool after a lever has been displaced to bring the free end of the tail into alignment with the head aperture of the tie.
Figure 4:
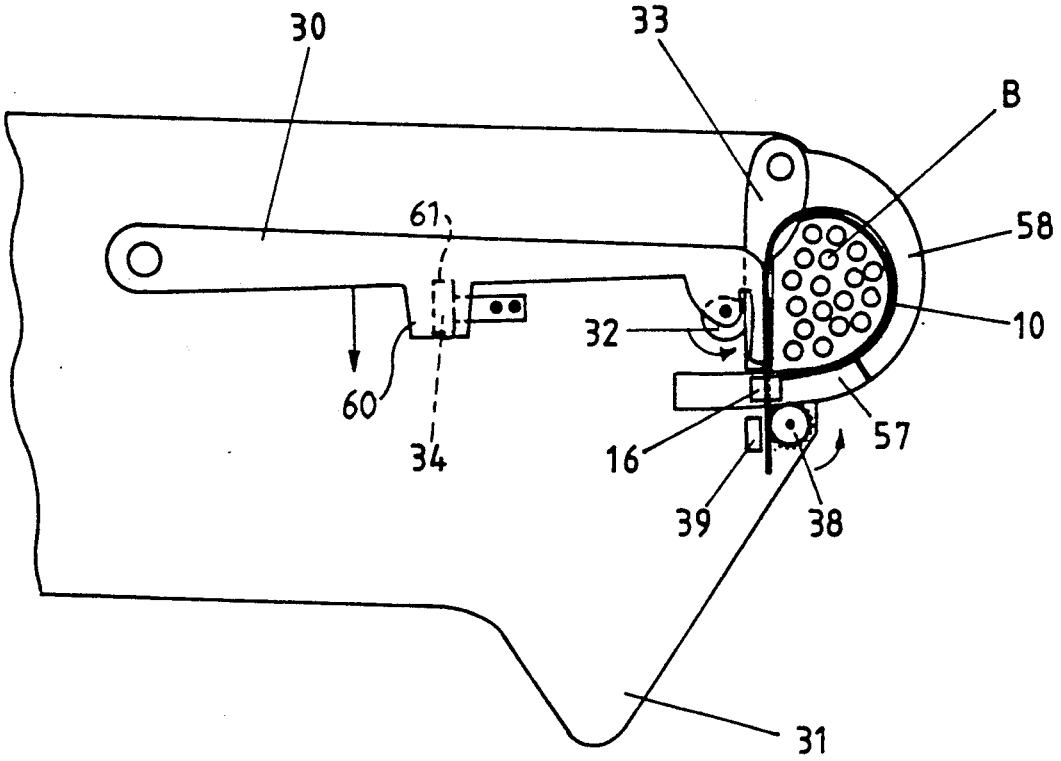
FIG. 4 is a view similar to FIG. 2, showing the positions of the tie and tool components after the threading mechanism has been displaced to push the free end of the tail through the apertured head of the tie and into engagement with the tensioning device.

As the tie driving mechanism drives the tie forward from the tool, the tail of the tie is guided around the bundle B of cables to be tied by the closed guide jaws 57, 58 and arrives at the position 10(F) shown in FIG. 1. The tool includes an operating lever 30 which is pivoted to a support plate 31 of the tool and carries a pressure wheel 32. A tie-engaging lever 33 is also pivoted to the support plate 31 and as the operating lever 30 is driven downwards, its pressure wheel 32 bears against a portion of the tie-engaging lever 33 to displace it around its pivot such that the tie-engaging lever 33 bears against the free end of the tie tail 18 to bring the latter into alignment with the aperture through the tie head 16. The tip of the tail is still spaced from the tie head, as shown in FIG. 2. As the operating lever 30 continues its downwards movement, a pressure wheel 34, also rotatably mounted to the tool support plate 31, engages an opposing surface 61 of a downwardly depending leg 60 of the operating lever 30. A downwardly-projecting extension 35 disposed at the forward end of the lever 30 has an inwardly directed nose 36 which now enters the notch recess 23 in the edge of the tie tail 18. The pressure wheel 34, in its rotation, drives the operating lever 30 downward with a slight sideways movement and thereby urges the nose 36 into the notch 23 and also urges the tie tail 18 so that its other edge 62 is pressed firmly agaist a fixed abutment 37 (FIG. 3). The free end of the tail is now directed accurately towards the head aperture. Further downwards movement of the operating lever 30 causes the nose 36 to push the tail of the tie through the head to project from the lower side of the head (FIG. 4). This movement inserts the free end of the tie tail between a rotary pinch wheel 38 and a fixed abutment 39.

Figure 5:
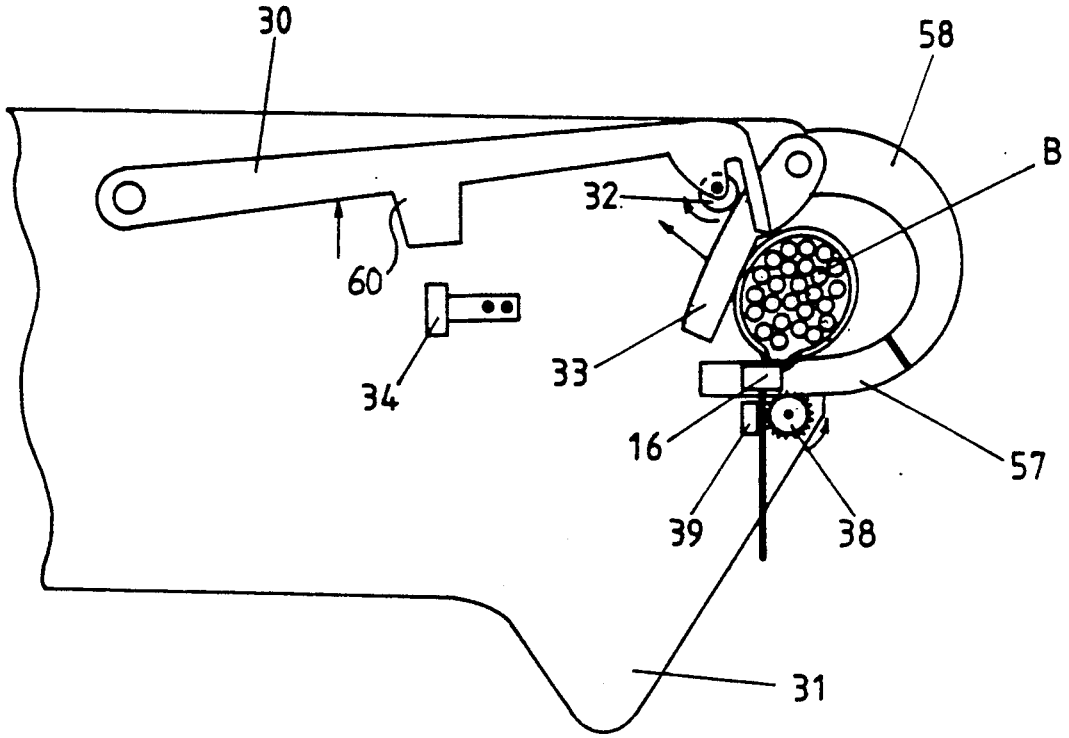
FIG. 5 is a similar view of the tool after the threading mechanism has returned to its rest position.

The operating lever 30 is now returned to its initial position allowing the closure lever 31 to return to its initial position (FIG. 5). The pinch wheel 38 is now driven to pull the tail through the head and tension the tie. Because the tie-engaging lever is able to move to its open position, it no longer bears against the bundle B is able to displace rearwardly as the tie is tensioned and this provides for a firmer tying of the cable bundle and a reduced protrusion of the tie head from the bundle. When the pinch wheel 38 has tightened the tie to a predetermined level of tension, a cutter is actuated automatically to sever the tail flush with the lower side of the head and jaw 58 is opened, as disclosed in said U.S. Pat. No. 4,640,320.

What is claimed is:

1. A tool for applying flexible, one-piece plastics ties around, for example, a bundle of cables, each tie having a flat tail and an apertured head at one end of the tail, the tie applying tool comprising means for driving tail-first from the tool a tie which is in a tail-forward, ready position within the tool, means at the forward end of the tool for guiding the tie tail around the bundle to be tied as the tie is driven from the tool so that, upon completion of the tie-driving and a guiding step, the free end of the tail is spaced from the head but is aligned with and directed towards the head aperture, and threading means for next engaging the free end of the tail and displacing it so that is passes through the head aperture to interlock therein, the threading means having a displaceable pushing member which positively engages engagement means formed with said tie.

2. A tool as claimed in claim 1, in which the threading means includes a displaceable pushing element and said engagement means of said tie includes a notch disposed in one edge of the tie tail, said displaceable pushing element engaging said tie tail notch and urging the free end of the tail through the head aperture.

3. A tool as claimed in claim 2, comprising an abutment adjacent the other edge of the tie tail and means for urging the other edge of the tie tail against said abutment.

4. A tool as claimed in claim 2, in which the guiding means includes a displacing element which guides said tie tail around said cable bundle into alignment with the aperture through the tie head the displacing element having a surface which engages a portion of said tie tail during such alignment.

5. A tool as claimed in claim 4, in which the displacing element is displaceable radially outwardly relative to the bundle to be tied once the tie tail has been pushed through the head aperture.

6. A tool as claimed in claim 5, comprising a reciprocally movable operating element which caries said pushing element and is coupled to said displacing element.

7. A one-piece tie of plastics material comprising a flat tail and an apertured head at one end of the tail, the tie having a notch formed integrally in said tie disposed in said tail adjacent its free end, said notch being adapted to engage a longitudinally displaceable pushing element of a tie-applying tool.

8. The one-piece tie of claim 7, wherein a plurality of said ties are arranged in a bandolier.

9. A tool for applying flexible, one-piece plastics ties around for example a bundle of cables, in combination with a bandolier which comprises a plurality of said ties connected together parallel to each other, each tie having a flat tail and an apertured head at one end of the tail, the tool comprising means for driving tail-first from the tool a tie which is in a tail-forward, ready position within the tool, means at the forward end of the tool for guiding the tie tail around the bundle to be tied as the tie is driven from the tool so that, upon completion of the tie-driving and guiding step, the free end of the tail is spaced from the head but is aligned with and directed towards the head aperture, and threading means including a pushing element for next positively engaging the free end of the tail, the pushing element further pushing said tail free end after engagement so that said tail free end passes through the head aperture and interlocks therein, each tie of said bandolier ties further including an engagement means integrally formed in said the end of said tie tail, said engagement means including a contact surface adapted to contact said tie tool threading means pushing element.

10. The tool-bandolier combinations of claim 9, wherein said tool threading means includes a downwardly depending elongated member and said engagement means of said tie includes a recess integrally formed in said tie.

11. A bandolier of flexible ties intended for use in an automatic tie gun for applying an individual flexible tie around an elongated bundle of cables and having means within the gun for separating individual ties from the bandolier during the successive application of said ties around said bundle, said tie gun further having means for aligning a tail portion of said tie into a position ready for displacement through an apertured head thereof and said tie gun further including means for engaging a contact surface integrally formed in said tie tail portion and displacing said tie tail portion through said tie apertured head, individual ties of said bandolier being joined together adjacent one another, wherein said bandolier comprises a plurality of individual flexible ties assembled in the form of a continuous belt, each individual tie having a tie body having a generally flat tail portion and an apertured head portion at opposite ends of said tie body, said tie tail and head portions lying in a substantially common place, said generally flat tail portions of said ties including a series of transverse serrations extending along said tail, said individual ties being disposed side-by-side in a predetermined spacing in said common place and in generally parallel relation with each other and being interconnected successively with one another adjacent the tail and apertured head portions of said ties by two integral, flexible continuous filaments, said filaments extending the entire length of said bandolier generally perpendicular to said individual ties, one filament interconnecting said tie tails of successive ties and the other filament interconnecting said tie heads of successive ties to maintain said individual ties in said predetermined spacing and generally parallel relationship in said common plane, each of said ties further including means for being engaged by a displaceable member of said tie gun and urged through said apertured tie head, in the form of a contact surface, the tie contact surface being integrally formed in each of said ties and disposed in said tie proximate to said tie tail.

12. The bandolier of claim 11, wherein said tie contact surface is disposed in a notch disposed in a longitudinal edge of said tie tail.

13. The bandolier of claim 11, wherein said contact surface is disposed in a recess disposed between opposite longitudinal edges of said tie.

14. In a combination for automatically applying an individual flexible tie from a supply of individual, interconnected flexible ties around an elongated bundle of wires, each of the ties having a tie body having a flat tail portion and an operational head portion at opposite ends of said tie body, said tie tail and head portions having a flat plane, said flat tail portion further including a series of transverse serrations adapted to engage an aperture ins aid tie head portion, said combination including a tool and said supply of interconnected flexible ties, the combination comprising:

a series of individual flexible ties assembled in the form of a belt wherein individual ties are disposed side-by-side in a flat plane and in generally parallel and flat relationship with each other, said individual flexible ties being interconnected successively with one another in a predetermined spacing by two integral flexible continuous filaments adjacent the head and tail portions of individual flat ties at opposite ends of said ties so as to form a tie supply bandolier, said filaments extending the entire length of said bandolier generally perpendicular to said individual ties whereby said individual ties are maintained in said predetermined spacing and generally parallel relationship with each other and generally perpendicular to said continuous filaments in the same flat plane to facilitate receipt of individual ties onto a tie tool indexing means, said individual, flexible ties each further including means for receiving a displacing element integrally formed in said ties proximate to said tie tails, said displacing element receiving means including a contact surface adapted to engage the displacing element; and a tie tool adapted to receive said tie supply bandolier, and apply an individual tie separated from said bandolier within said tool around said wire bundle, the tool including means for separating an individual leading tie from said tie supply bandolier for use in said tie tool by severing said continuous bandolier filaments adjacent said tie head and tail portions as leading ties of said bandolier are advanced through said tie tool, tie-driving means including a rotatable wheel for driving each separated leading tie out of said tool and around said bundle, guide means at the forward end of said tool for guiding each separated driven individual tie around said wire bundle, said guide means further aligning each said driven tie such that the free end of said tie tail is spaced apart from said tie head aperture and positioned in alignment therewith in said guide means, said tie driving means further including a rotatable cam wheel for pushing the cable tie head of said driven tie past said tie-driving means and into said guide means, said cam wheel being spaced apart from said tie driving means to provide a reaction surface for said tie driving means, means for threading said tie tail of said driven tie through said apertured tie head to interlock therewith, said tie threading means including a displacing element having a tie engagement surface of thereon adapted to engage said contact surface of said tie, tie tensioning means for tensioning said driven tie around said wire bundle including a rotatable wheel adapted to engage said free end of said tie tail once passed through said apertured head by said threading means, and a knife for cutting said tie tail of said tensioned tie behind said tie head.

15. The combination of claim 14, wherein a portion of said tie guide means is operatively associated with said tie threading means.

16. The combination of claim 15, wherein said portion of said tie guide means includes a pivoting tie-engaging lever, said tie-engaging lever having a reaction surface which is engaged by a rotating pressure wheel disposed on a tie-threading means lever, the tie-threading means further including a leg portion which includes a reaction surface thereon, said tie-threading means lever leg portion reaction surface being engaged by a second rotatable pressure wheel which applies a sideways movement to said tie-threading lever to move said tie against an additional tie guide means.

17. The combination of claim 14, wherein said tie displacing element receiving means includes a notch disposed in a longitudinal edge of said tie.

18. The combination of claim 14, wherein said tie displacing element receiving means includes a recess.

* * * * *